US010457464B2

(12) United States Patent
Lv et al.

(10) Patent No.: US 10,457,464 B2
(45) Date of Patent: Oct. 29, 2019

(54) CUSHION STRUCTURE AND PACKAGING ASSEMBLY

(71) Applicants: BOE TECHNOLOGY GROUP CO., LTD., Beijing (CN); HEFEI XINSHENG OPTOELECTRONICS TECHNOLOGY CO., LTD., Hefei (CN)

(72) Inventors: Chao Lv, Beijing (CN); Baoyong Nie, Beijing (CN); Zhiyu Qian, Beijing (CN); Zhengyuan Zhang, Beijing (CN); Yanping Li, Beijing (CN); Yong Sun, Beijing (CN); Jun Zhang, Beijing (CN); Long Yan, Beijing (CN); Zhiyuan Chen, Beijing (CN)

(73) Assignees: BOE TECHNOLOGY GROUP CO., LTD., Beijing (CN); HEFEI XINSHENG OPTOELECTRONICS TECHNOLOGY CO., LTD., Hefei (CN)

( * ) Notice: Subject to any disclaimer, the term of this patent is extended or adjusted under 35 U.S.C. 154(b) by 0 days.

(21) Appl. No.: 15/304,859

(22) PCT Filed: May 20, 2016

(86) PCT No.: PCT/CN2016/082895
§ 371 (c)(1),
(2) Date: Oct. 17, 2016

(87) PCT Pub. No.: WO2017/059682
PCT Pub. Date: Apr. 13, 2017

(65) Prior Publication Data

US 2018/0201427 A1 Jul. 19, 2018

(30) Foreign Application Priority Data

Oct. 10, 2015 (CN) ..... 2015 1 0652632

(51) Int. Cl.
*B65D 81/107* (2006.01)
*B65D 85/68* (2006.01)

(52) U.S. Cl.
CPC ..... *B65D 81/107* (2013.01); *B65D 85/68* (2013.01); *B65D 2213/02* (2013.01); *B65D 2581/055* (2013.01); *B65D 2585/6837* (2013.01)

(58) Field of Classification Search
CPC .. B65D 81/107; B65D 85/68; B65D 2213/02; B65D 2581/055; B65D 81/053; B65D 81/054
(Continued)

(56) References Cited

U.S. PATENT DOCUMENTS 5,366,080 A * 11/1994 Carstersen ..... B65D 81/113 206/523
7,644,820 B2 * 1/2010 Hohne ..... B65D 81/053 206/449
(Continued)

FOREIGN PATENT DOCUMENTS

CN 200974674 Y 11/2007
CN 102774567 A 11/2012
(Continued)

OTHER PUBLICATIONS

1st Office Action dated Feb. 28, 2017 in CN201510652632.0.
(Continued)

*Primary Examiner* — Steven A. Reynolds
(74) *Attorney, Agent, or Firm* — Syncoda LLC; Feng Ma

(57) ABSTRACT

A cushion structure for use with a packaging case provides cushion and protection of an object. The cushion structure includes a first member and a second member. The first member is configured to snuggly receive the object; the second member is configured to be mounted onto a case
(Continued)

body of the packaging case; and the first member and the second member are detachably coupled.

9 Claims, 9 Drawing Sheets

(58) Field of Classification Search
USPC ..... 206/521, 586, 523, 453
See application file for complete search history.

(56) References Cited

U.S. PATENT DOCUMENTS

| | | | | |
|---|---|---|---|---|
| 8,777,007 | B2 * | 7/2014 | Chen | B65D 81/05 206/454 |
| 8,789,698 | B2 * | 7/2014 | Kuo | B65D 81/107 206/449 |
| 9,045,273 | B2 * | 6/2015 | Guo | B65D 81/056 |
| 9,533,815 | B2 * | 1/2017 | Hu | B65D 81/05 |
| 10,065,783 | B2 * | 9/2018 | Zhao | B65D 11/10 |
| 2008/0112115 | A1 | 5/2008 | Yang | |
| 2008/0128310 | A1 * | 6/2008 | Kao | B65D 81/107 206/521 |
| 2013/0286320 | A1 * | 10/2013 | Kuo | G02F 1/133308 349/58 |
| 2013/0308074 | A1 * | 11/2013 | Park | G02B 6/0088 349/58 |
| 2014/0069834 | A1 * | 3/2014 | Kuo | B65D 81/022 206/454 |
| 2014/0069835 | A1 * | 3/2014 | Kuo | B65D 81/05 206/454 |
| 2014/0097121 | A1 * | 4/2014 | Chen | B65D 85/48 206/586 |
| 2015/0101953 | A1 | 4/2015 | Yue et al. | |

FOREIGN PATENT DOCUMENTS

| | | | |
|---|---|---|---|
| CN | 102849340 | A | 1/2013 |
| CN | 103466202 | A | 12/2013 |
| CN | 204433395 | U | 7/2015 |

OTHER PUBLICATIONS

International Search Report and Written Opinion dated Jul. 6, 2016 in PCT/CN2016/082895.
Extended European Search Report dated Apr. 4, 2019 in EP16766829.2.

* cited by examiner

CUSHION STRUCTURE AND PACKAGING ASSEMBLY

CROSS-REFERENCES TO RELATED APPLICATION

The present application claims priority to Chinese Patent Application No. 201510652632.0 filed on Oct. 10, 2015, the disclosure of which is hereby incorporated by reference in its entirety.

TECHNICAL FIELD

The present disclosure relates generally to the technical field of packaging, and more specifically to a cushion structure for use with packaging cases, and to a packaging assembly containing the cushion structure.

BACKGROUND

In the field of packaging, cushion structures are frequently used for cushioning and protecting goods during shipment and handling.

Existing cushion structures typically include independent cushioning parts that are disposed inside packaging cases. In order to achieve diverse functions, most cushion structures currently on the market commonly employ two or more components that are assembled together to form the cushioning structures.

Different components of a cushion structure are typically assembled in two methods. In a first method, chemicals, and typically adhesives, are used in the assembly of different components in a cushion structure. In a second method, different components in a cushion structure can be assembled through physical interactions, such as ultrasonic welding.

SUMMARY

The present disclosure provides a cushion structure and a packaging assembly for use with packaging cases. The cushion structures can provide secure connections among different members and has a low cost for overall use. According to some embodiments, the cushion structures include a plurality of members, such as insets, which can be plugged or snapped together, and thus can have different shapes and sizes. As such, a universal or interchangeable cushion structure can be provided for packaging objects with varying shapes and sizes, such as large-screen display devices with many spaces in the packaging cases.

The cushion structure can include a first member and a second member. In some embodiments, the first member is configured to snuggly receive the object; the second member is configured to be mounted onto a case body of the packaging case; and the first member and the second member are detachably coupled. Herein the term "member" can be used to refer an individual part, a component, or a portion or a structure. A "member" can comprise different parts, portions, or components, or can be an integral portion.

The second member is configured to be mounted onto a case body of the packaging case, such as snuggly fit into the packaging case, particular at the corners. The first member can comprise a flexible and anti-static material and is configured to come into contact with the object disposed in the packaging case. The first member and the second member are detachably coupled together. As such, the cushion structure can be used in the packaging of static-electricity-sensitive objects.

In the cushion structure according to some embodiments, the first member is configured to come into contact with a static electricity-sensitive object. The use of a flexible and anti-static material in the first member can reduce the static electricity generated by the object disposed in the packaging case.

The second member can be mounted on the case body of the packaging case, and serve to provide positioning and cushioning to the object to be packaged. Furthermore, the first member and the second member can be detachably coupled together. Without use of adhesives, possible smearing and contamination of the object from overflow of the adhesives can be avoided.

Meanwhile, a secure connection between the first member and the second member can thus be achieved without the use of adhesives. If any one of the first member and the second member is damaged, the other undamaged member can be re-assembled with other members to form a cushion structure, thereby reducing the operational cost through replaceable and interchangeable members. As such, the cushion structure described above for use with packaging cases has a more secure connection between different cushion members, and a low operational cost.

The static-electricity-sensitive object to be packaged can be an electronic device, such as a display device, a TV particularly a large-screen TV, a computer, or any other electronic devices with regular or irregular shapes. In the case of a display device, it can be a liquid crystal display (LCD) device, or light-emitting diode (LED) device, an organic light-emitting diode (OLED) device, etc. Other examples of electronics device include, for example, a stand-alone plug-and-play display device, a smart TV, a computer screen, a server, etc.

In some embodiment, the flexible and anti-static material used in the first member can be Pink Poly foam, but can also be or include some other materials.

In some embodiments, the second member can comprise acrylonitrile butadiene styrene, but can have compositions of other materials.

In some embodiments, the detachable coupling between the first member and the second member can be achieved by a least one docking slot and at least one docking portion, wherein the at least one docking portion is configured to be detachably mounted into the at least one docking slot.

In some embodiments, the at least one docking slot can be arranged on the first member, and the at least one docking portion can be arranged on the second member. In some other embodiments, the docking slot and the docking portion can be disposed respectively at the second member, and the first member, respectively. Yet in some other embodiments, the docking slot and docking portion each are not necessarily complete components disposed on the first member or the second member, but rather can be shared by the first and second members.

The terms "docking slot" and "docking portion" shall be interpreted in a broad sense. The docking slot can be a concave indentation that can be of a linear shape, but can be of any other shapes; the docking portion can be a convex part that can be of any shape and can comprise an integral part of an object, or can comprise other components to form the convex shape.

In some embodiments, the first member is provided with a hollow structure, wherein the at least one docking slot is arranged on a side plate of the hollow structure; and the at least one docking portion of the second member is configured to be embedded in the hollow structure through the at least one docking slot. In some embodiments, the first member comprises a cuboid structure.

The second member can take various different shapes. In some embodiments, the second member has an "I"-shaped cross section. In some other embodiments, the second member has an "L"-shaped cross section. Yet in some other embodiments, the second member has a "Z"-shaped cross section.

In some embodiments where the second member has an "I"-shaped cross section, the second member can comprise a first parallel plate, a second parallel plate, and an intermediate plate. The first parallel plate and the second parallel plate are arranged to be parallel, the intermediate plate is arranged to be perpendicular to, and is configured to couple, the first parallel plate and the second parallel plate, and the first parallel plate forms the at least one docking portion.

In some embodiments where the second member has an "I"-shaped cross section, the second member can further comprise a docking groove, arranged on the intermediate plate on a region where the intermediate plate couples the first parallel plate; one end of the first member is provided with an opening, wherein the side plate is at a periphery of the opening of the cuboid structure, the side plate is provided with a docking slot, and the docking slot at the side plate is coupled with the opening. The docking groove is mounted through the docking slot with the side plate on a region of the side plate opposite to the opening.

In some embodiments where the second member has an "I"-shaped cross section, the second member can further comprise two docking grooves, respectively arranged at two ends of the first parallel plate, at a direction in parallel to a crossline between the intermediate plate and the first parallel plate and towards a surface of the second parallel plate; the side plate of the hollow structure of the first member is provided with two docking slots; and one of the two docking grooves is mounted with one of the two docking slots at one end of the side plate, and another one of the two docking grooves is mounted with another one of the two docking slots at another end of the side plate.

In some embodiments where the second member has an "L"-shaped cross section, the second member can comprise a fixing plate, configured to attach the case body of the packaging case; and a docking plate, configured to be the at least one docking portion. In some of these embodiments, the second member further comprises two docking grooves, respectively arranged at two ends of the docking plate, wherein the two docking grooves extend in a direction in parallel with a crossline between the fixing plate and the docking plate, and have their respective openings arranged at opposite directions; the side plate of the hollow structure of the first portion is provided with two docking slots; and the docking plate of the second member is mounted into the hollow structure of the first member such that one of the two docking grooves on the docking plate is mounted with one of the two docking slots of the first member.

In some embodiments where the second member has an "Z"-shaped cross section, the second member may comprise a third parallel plate; a fourth parallel plate; and an intermediate plate; wherein the third parallel plate and the fourth parallel plate are arranged to be parallel, the intermediate plate is arranged to be perpendicular to, and is configured to couple, the third parallel plate and the fourth parallel plate, and the third parallel plate is the at least one docking portion.

In some embodiments, the second member can further comprise two docking grooves, having opposing openings and arranged on the intermediate plate on a region facing away from the fourth parallel plate and between the intermediate plate and the third parallel plate.

In a first set of implementations, one end of the first member is provided with an opening, wherein the side plate is at a periphery of the opening of the cuboid structure, the side plate is provided a docking slot, and the docking slot on the side plate is coupled with the opening; and one of the two docking grooves is mounted through the docking slot with the side plate on a region of the side plate opposite to the opening.

In a second set of implementations, the side plate of the hollow structure of the first member is provided with two docking slots; and one of the two docking grooves is mounted with one of the two docking slots at one end of the side plate, and another one of the two docking grooves is mounted with another one of the two docking slots at another end of the side plate.

In another aspect, a packaging assembly containing the cushion structures described above is provided.

The packaging assembly can include a packaging case, wherein the packaging case comprises at least one cushion structure according to any of the embodiments disclosed above, and the at least one cushion structure is disposed in, and coupled with or mounted onto a case body of, the packaging case. Because the cushion structure used in packaging cases can form a secure connection between different cushion members and has a low cost for overall use, the packaging assembly can provide a good protection of the object to be packaged, and also enjoys a low operational cost.

In some embodiments, the case body of the packaging case is provided with a mounting groove, configured to mount the second member.

In some embodiments, the at least one cushion structure is coupled with, or mounted onto, a case body of the packaging case through a detachable mechanism.

In some embodiments, the detachable mechanism comprises at least one mounting groove, arranged on the case body of the packaging case and configured to mount the second member.

In another aspect, a method of assembling a cushion structure is provided according to some of the embodiments as described above.

In some embodiments, the method of assembling a cushion structure comprises the step of moving the first member or the second member, such that the at least one docking portion of the second member slides through the at least one docking slot on the first member and is substantially embedded into the hollow structure of the first member so as to form a secure connection between the first member and the second member.

In some embodiments, where the second member has an "I"-shaped cross section, the first parallel plate of the second member forms the at least one docking portion, and the method of assembling a cushion structure comprises the step of moving the first member or the second member, such that the first parallel plate of the second member slides through the at least one docking slot and is substantially embedded into the hollow structure of the first member so as to form a secure connection between the first member and the second member.

In some embodiments, where the second member has an "L"-shaped cross section, the docking plate of the second member is the at least one docking portion, and the method of assembling a cushion structure comprises the step of moving the first member or the second member, such that the docking plate of the second member slides through the at least one docking slot and is substantially embedded into the hollow structure of the first member so as to form a secure connection between the first member and the second member.

In some embodiments, where the second member has a "Z"-shaped cross section, the third parallel plate of the second member is the at least one docking portion, and the method of assembling a cushion structure comprises the step of moving the first member or the second member, such that the third parallel plate of the second member slides through the at least one docking slot and is substantially embedded into the hollow structure of the first member so as to form a secure connection between the first member and the second member.

In another aspect, a method of assembling a cushion structure as described above is provided. The cushion structure substantially includes a first member, configured to snuggly receive the object, and a second member, configured to be mounted onto a case body of the packaging case; and the first member and the second member are configured to be detachably coupled. The method substantially comprises the step of moving one of the first member and the second member toward another one of the first member and the second member such that the first member and the second member are securely coupled.

In some implementations, the first member of the cushion structure is provided with at least one docking slot, arranged on a side plate of a hollow structure, the second member is provided with at least one docking portion and is configured to be mounted onto a case body of the packaging case, and the method substantially comprises moving one of the first member and the second member toward another one of the first member and the second member such that the at least one docking portion of the second member slides through the at least one docking slot on the first member and is substantially embedded into the hollow structure of the first member so as to form a secure connection between the first member and the second member. Various embodiments are possible for the method of assembling a cushion structure, depending on the various embodiments of the cushion structure as described above.

In yet another aspect, a method of packaging an object is provided. The method comprises the steps of: (1) providing a packaging case and at least one cushion structure; and (2) arranging the at least one cushion structure and the object in the packaging case.

In step (1), the at least one cushion structure is configured to be disposed in the packaging case; each of the at least one cushion structure comprises a first member and a second member; the first member is configured to snuggly receive the object; the second member is configured to be mounted onto a case body of the packaging case; and the first member and the second member are configured to be securely and detachably coupled. In step (2), the at least one cushion structure and the object are disposed in the packaging case; the second member of the each of the at least one cushion structure is mounted onto the case body of the packaging case; the first member of the each of the at least one cushion structure and the second member of the each of the at least one cushion structure are securely coupled; and the first member of the each of the at least one cushion structure snuggly receives the object.

Various embodiments are possible for the method of packaging the object using the packaging case and the at least one cushion structure. In a first embodiment, the at least one cushion structure can be assembled first by coupling the first member and the second member in each cushion structure followed by mounting on the case body of the packaging case and disposing the object in the packaging case. In a second embodiment, the second member can be mounted onto the case body of the packaging case first, followed by disposing the object in the packaging case and mounting the first member to complete the assembly of the at least one cushion structure. The first embodiment and the second embodiment can have mixed use for different sets of the at least one cushion structure.

Other embodiments and implementations may become apparent in view of the following descriptions and the attached drawings.

BRIEF DESCRIPTION OF DRAWINGS

To more clearly illustrate some of the embodiments, the following is a brief description of the drawings. The drawings in the following descriptions are only illustrative of some embodiments. For those of ordinary skill in the art, without the premise of inventive efforts, other drawings of other embodiments can become apparent based on these drawings.

DETAILED DESCRIPTION

In the following, with reference to the drawings of various embodiments disclosed herein, the technical solutions of the embodiments of the invention will be described in a clear and fully understandable way. It is noted that the described embodiments are merely a portion but not all of the embodiments of the invention. Based on the described embodiments of the invention, those ordinarily skilled in the art can obtain other embodiment(s), without any inventive work, which come(s) within the scope sought for protection by the invention.

The present disclosure relates to the technical field of packaging, and provides a cushion structure for use with packaging cases for a static-electricity-sensitive object, a packaging assembly containing the cushion structure, and an assembly method thereof.

The cushion structure comprises a first member and a second member, wherein the second member is mounted onto a case body of the packaging case; the first member comprises a flexible and anti-static material and is configured to come into contact with the static electricity-sensitive object disposed in the packaging case; and the first member and the second member are coupled via a detachable mechanism.

In the cushion structure as disclosed herein, the first member can reduce the static electricity generated in the packaging case. The second member is mounted on the case body of the packaging case, which serves to provide positioning and cushioning to the electronic device. Furthermore, the first member and the second member are detachably and securely connected, and if any one of the first member and the second member is damaged, the other unbroken member can be re-assembled with other members to form a cushion structure.

For electronic devices such as LCD and LED devices, the cushion structures disclosed herein are of particular importance for providing anti-static functions, in addition to functions of cushioning and positioning.

In existing packaging technologies that employ adhesives, a large quality and high quantity of the adhesives are needed. Smearing and contamination of the object in contact with the cushion structures can result from overflow of the adhesives. In some other approaches of assembled cushion structures, different cushion components can fall apart caused by mismatch of the adhesives and the components, poor quality of the adhesives, or insufficient use of the adhesives.

In some approaches, components in cushion structures assembled using different components can fit each other with a high accuracy, but they usually cannot detach from each other. As such, if one of the multiple components gets damaged, the whole cushion has to be discarded, incurring a high cost for the overall use of this type of cushion structures.

Figure 1:
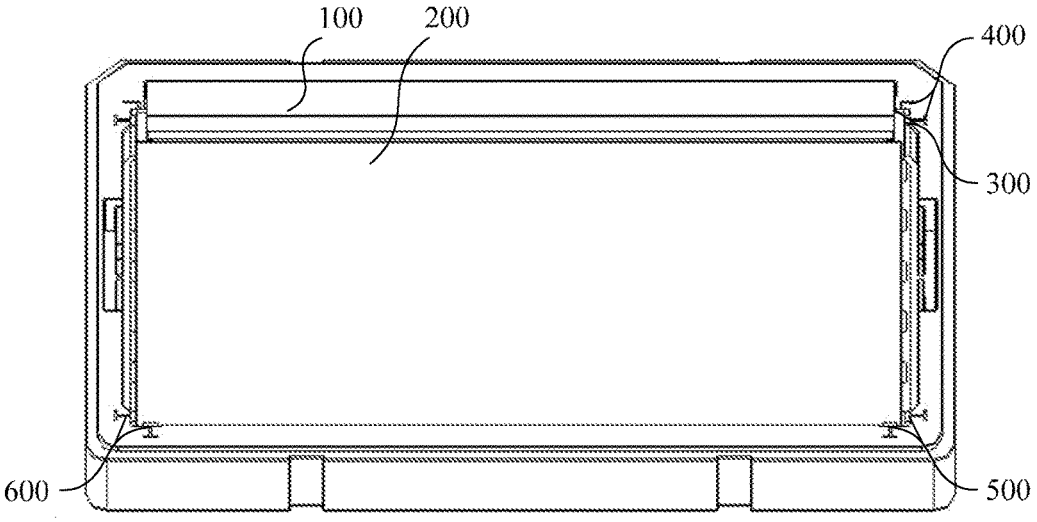
FIG. 1 illustrates a schematic diagram of a cushion structure according to some embodiments.

FIGS. 1 and 2 illustrate a schematic diagram of a cushion structure according to some embodiments disclosed herein, which can have advantages such as secure connections between different members and has a low cost for overall use.

For example, if the anti-static member, which comes into contact with the object being packaged, is damaged or worn out after multiple impacts by the object, it can be easily detached from other members, and a new anti-static member can be plugged in with the other members to become a nearly-new cushion structure again.

As illustrated in FIGS. 1 and 2, the cushion structure for use with a packaging case 100 comprises a first member 300 and a second member 400, wherein the second member 400 is configured to be mounted onto a case body of the packaging case 100, the first member 300 comprises a flexible and anti-static material and is configured to come into contact with a electronic device 200 disposed in the packaging case 100; the first member 300 and the second member 400 are detachably coupled.

In some embodiments, the first member 300 snuggly receives the object to be packaged. The second member can be snuggly fit into the packaging case 100, particularly at the corners.

In the cushion structure for use with the packaging case 100 as described above, the first portion 300 that is configured to contact the electronic device 200 comprises a flexible anti-static material, which can reduce the static electricity generated by the electronic device 200 disposed in the packaging case 100. The second member 400 is coupled to the case body of the packaging case 100, serving to provide positioning and cushioning for the electronic device 200. The first member 300 and the second member 400 are detachably coupled together without the use of adhesives, thus avoiding the possible smearing and contamination of the electronic device 200 resulting from overflow of the adhesives.

Furthermore, it can achieve a stable coupling or secure connection between the first member 300 and the second member 400, and if any one of the first member 300 or the second member 400 is damaged, the other undamaged member can be re-assembled with other members to form a cushion structure, thereby reducing operational cost of the cushion structures.

As such, the cushion structure for use with the packaging case 100 has strong connections among different cushion members, and has a low operational cost.

To better realize the positioning and cushioning functions of the second member 400 in the cushion structure, the second member 400 can comprise acrylonitrile butadiene styrene (ABS) in some preferred embodiments. As a thermoplastic polymer with high strength, toughness and moldability, ABS has outstanding mechanical properties including excellent impact and wear resistance, high dimensional stability, and convenience for processing, and thus can be used to make the second member 400 that has the positioning and cushioning functions.

Figure 2A:
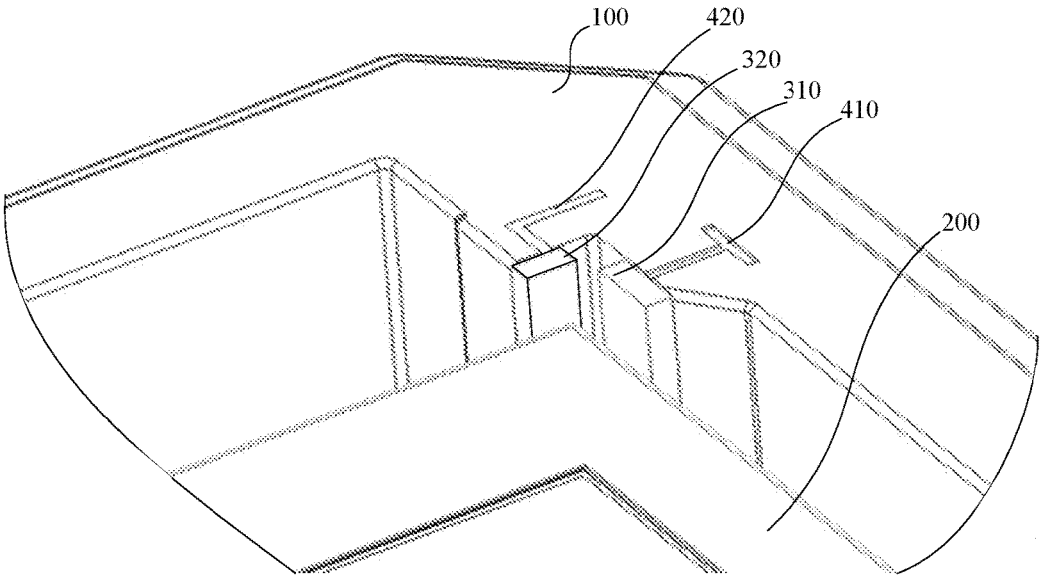
FIG. 2A is a magnified view of a corner portion of FIG. 1 illustrating the fitting of a electronic device within a packaging case with the cushion structure according to some embodiments.
Figure 2B:
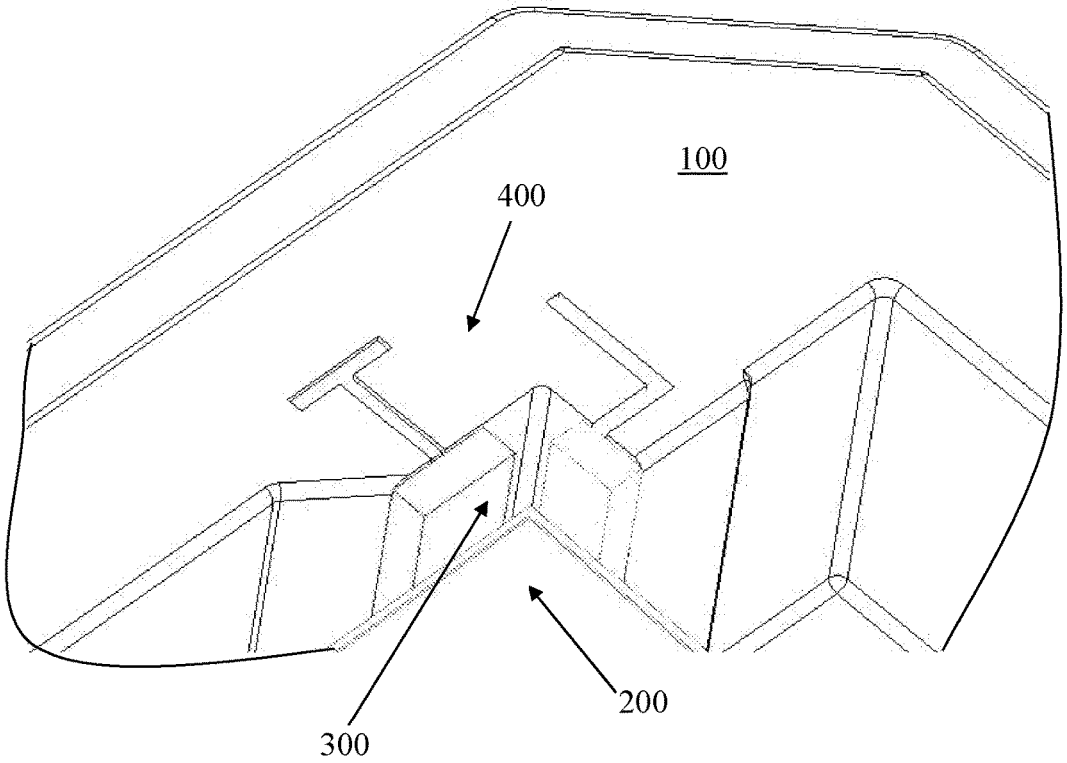
FIG. 2B is a magnified view of another corner portion of FIG. 1 illustrating the fitting of an electronic device within a packaging case with the cushion structure according to some embodiments.

As illustrated in FIG. 1 and FIGS. 2A and 2B, to realize the detachable coupling between the first member 300 and the second member 400, in some embodiments, the first member 300 is configured to have a substantially hollow structure, and a side plate of the hollow structure is arranged with one or more docking slots 500; the second member 400 is provided with a docking portion 600, configured to be embedded in the hollow structure (of the first member 300) through the docking slot 500.

The docking portion 600 of the second member 400 functions with the docking slot 500 in the first member 300, to achieve a detachable connection, whereby the cushion structure can be completed by simple modular docking or plug in, making it easy, quick, and convenient to operate. In addition, the first member 300 and the second member 400 can be adjusted to have varying parameters such as sizes, shapes, compositions, and properties, so as to make a cushion structure with different properties, adapted to securely fitting the packaging case 100 to provide good protections of the electronic device 200 in various environments.

If any one of the first member 300 or the second member 400 is damaged, the other undamaged member can be re-assembled with other members to form a cushion structure, thus reducing the operational cost of the cushion structures. For example, the first member 300 can be damaged through multiple impact by the object packaged therein, such as by sharp corners of the object. In some other cases, the second member 400 can be damaged after multiple times being mounted into a packaging case.

In some embodiments, the first member 300 can have a shape of a cuboid, and can be formed with multiple different approaches.

Figure 3:
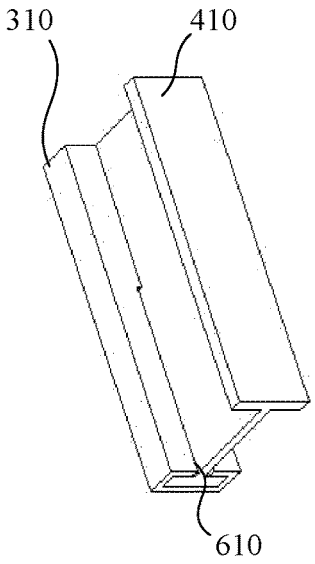
FIG. 3 is a schematic diagram of a cushion structure according to some embodiments of the present disclosure.
Figure 4:
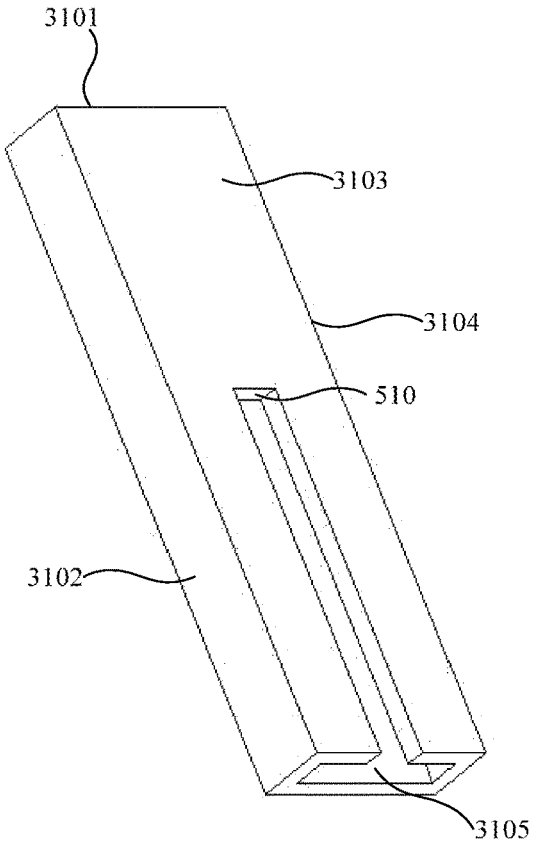
FIG. 4 is a schematic diagram of a first member of the cushion structure as illustrated in FIG. 3, according to some embodiments.

Approach 1: As illustrated in FIGS. 3 and 4, the first member 310 comprises a cuboid structure, formed by parallel-arranged side plate 3103 and side plate 3105, parallel-arranged side plate 3102 and side plate 3104, and a side plate 3101, wherein the side plate 3103, the side plate 3102, the side plate 3105 and the side plate 3104 are successively perpendicular to one another, the side plate 3103, the side plate 3102, the side plate 3105 and the side plate 3104 are respectively perpendicular to the side plate 3101, and the side plate 3103 is provided with a docking slot 510.

Figure 6:
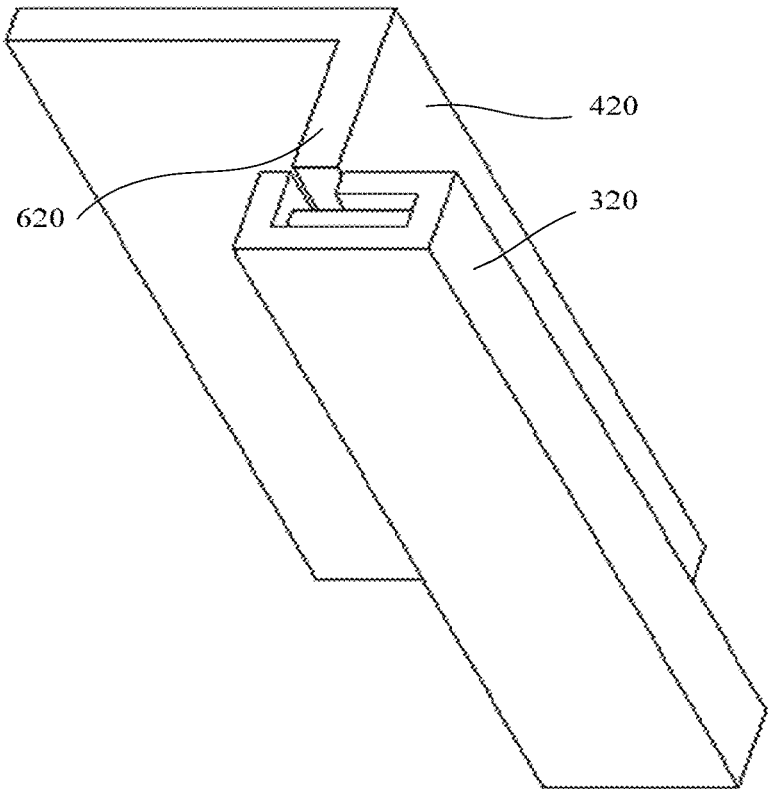
FIG. 6 is a schematic diagram of a cushion structure according to some embodiments.
Figure 7:
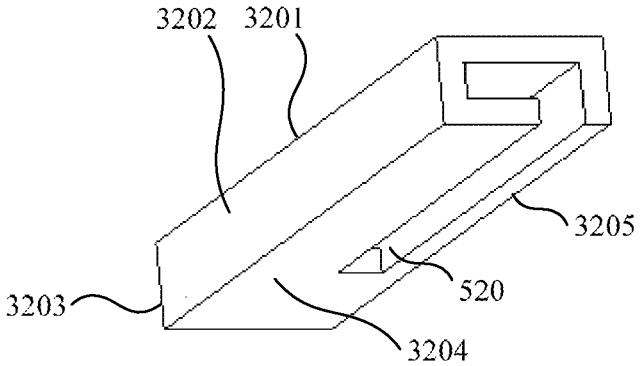
FIG. 7 is a schematic diagram of a first member of the cushion structure as illustrated in FIG. 6, according to some embodiments.

Approach 2: As illustrated in FIGS. 6 and 7, the first member 320 comprises a cuboid structure, formed by parallel-arranged side plate 3201 and side plate 3204, parallel-arranged side plate 3202 and side plate 3205, and a side plate 3203, wherein the side plate 3201, the side plate 3202, the side plate 3204 and the side plate 3205 are successively perpendicular to one another, the side plate 3201, the side plate 3202, the side plate 3204 and the side plate 3205 are respectively perpendicular to the side plate 3203, and the side plate 3204 is provided with a docking slot 520.

Figure 9:
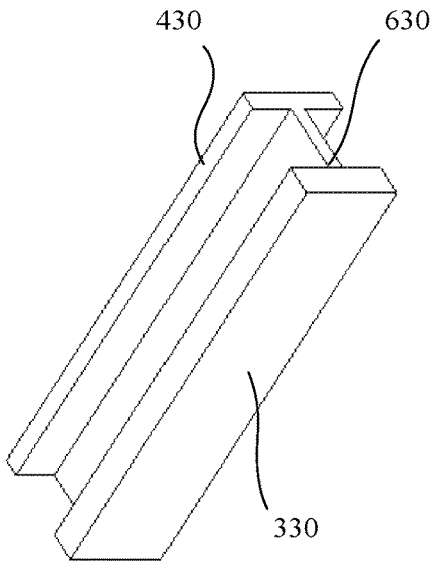
FIG. 9 is a schematic diagram of a cushion structure according to some embodiments.
Figure 10:
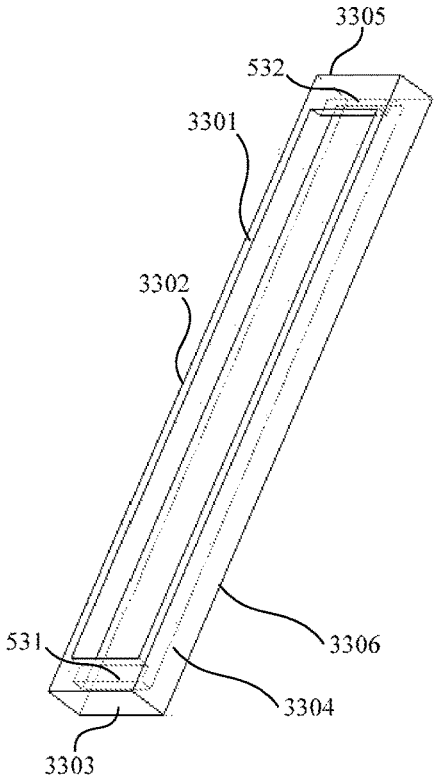
FIG. 10 is a schematic diagram of a first member of the cushion structure as illustrated in FIG. 9, according to some embodiments.

Approach 3: As illustrated in FIGS. 9 and 10, the first member 330 comprises a cuboid structure, formed by parallel-arranged side plate 3301 and side plate 3306, parallel-arranged side plate 3302 and side plate 3304, and parallel-arranged side plate 3303 and side plate 3305, wherein the side plate 3301, the side plate 3302, the side plate 3306 and the side plate 3304 are successively perpendicular to one another, the side plate 3301, the side plate 3302, the side plate 3306 and the side plate 3304 are respectively perpendicular to each of the side plate 3303 and the side plate 3305, and the side plate 3301 is provided with a first docking slot 531 and a second docking slot 532.

Figure 12:
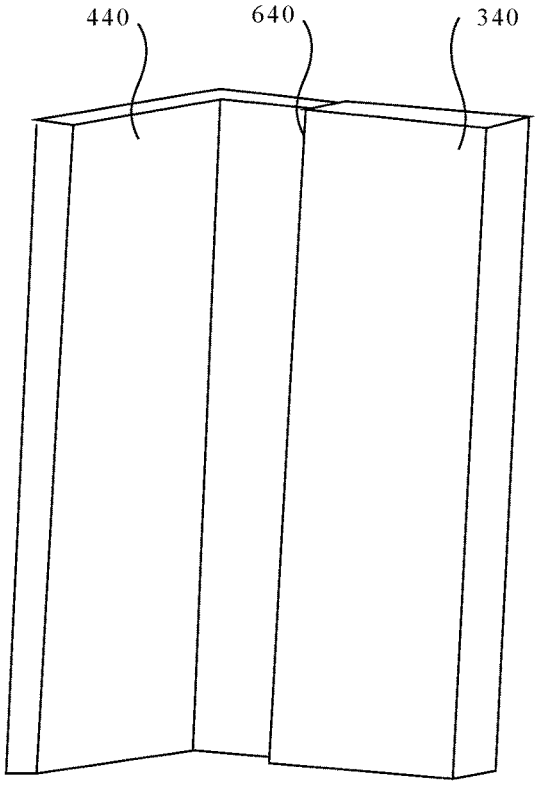
FIG. 12 is a schematic diagram of a cushion structure according to some embodiments.
Figure 13:
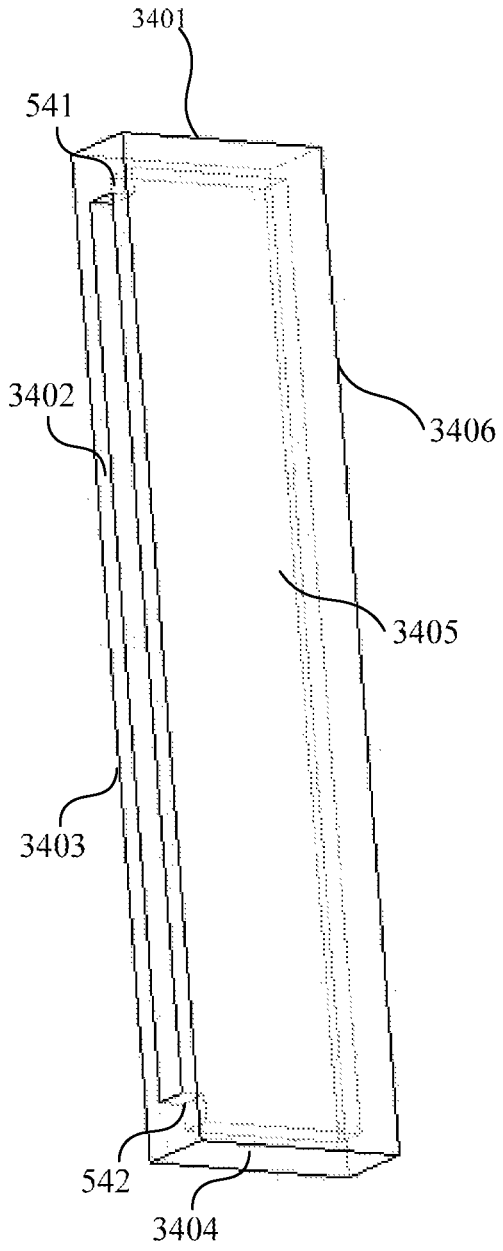
FIG. 13 is a schematic diagram of a first member of the cushion structure as illustrated in FIG. 12, according to some embodiments.

Approach 4: As illustrated in FIGS. 12 and 13, the first member 340 comprises a cuboid structure, formed by parallel-arranged side plate 3402 and side plate 3406, parallel-arranged side plate 3405 and side plate 3403, and parallel-arranged side plate 3401 and side plate 3404, wherein the side plate 3402, the side plate 3403, the side plate 3406 and the side plate 3405 are successively perpendicular to one another, the side plate 3402, the side plate 3403, the side plate 3406 and the side plate 3405 are respectively perpendicular to each of the side plate 3401 and the side plate 3404, and the side plate 3402 is provided with a first docking slot 541 and a second docking slot 542.

Based on the cushion structure used with packaging cases as described above, to function with the different embodiments of the first member 300, which comprises a cuboid structure, in some embodiments, the second member 400 can have different shapes, such as having a cross section of "I"-shape, "L"-shape, or "Z"-shape.

In cases where the second member 400 has a cross section shaped similar to an "I," a configuration can be selected among two or more implementations.

Figure 5:
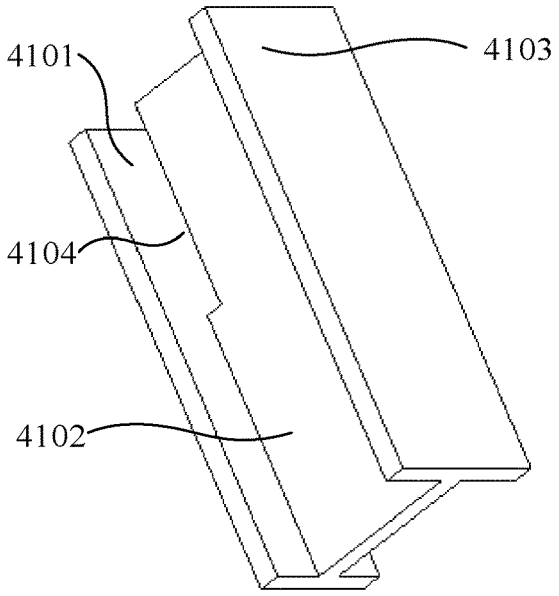
FIG. 5 is a schematic diagram of a second member of the cushion structure as illustrated in FIG. 3, according to some embodiments.

In a first implementation, as illustrated in FIGS. 3 and 5, the second member 410 has an "I"-shaped cross section and is matched with the first member 310, shown in FIG. 4 as a cuboid structure in Approach 1 of the first member 300, to form a cushion structure.

Figure 11:
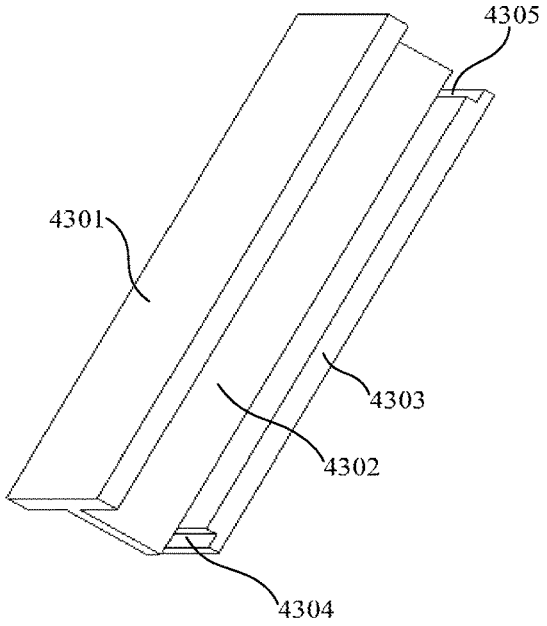
FIG. 11 is a schematic diagram of a second member of the cushion structure as illustrated in FIG. 9, according to some embodiments.

In a second implementation, as illustrated in FIGS. 9 and 11, the second member 430 has an "I"-shaped cross section and is matched with the first member 330, shown in FIG. 10 as a cuboid structure in Approach 3 of the first member 300, to form a cushion structure.

In the first implementation, as shown in FIGS. 3 and 5, the second member 410 comprises a first parallel plate 4101, a second parallel plate 4103, and an intermediate plate 4102, wherein the first parallel plate 4101 and the second parallel plate 4103 are arranged to be parallel, the intermediate plate 4102 is arranged to be perpendicular to, and is configured to connect, the first parallel plate 4101 and the second parallel plate 4103, and the first parallel plate 4101 is a docking portion 610.

A docking groove 4104 is arranged where the intermediate plate 4102 connects the first parallel plate 4101. One end of the first member 310 is provided with an opening, a docking slot 510 is arranged on a side plate 3103 of the cuboid structure and is coupled with the opening, wherein the side plate 3103 is at a periphery of the opening in the cuboid structure.

The docking groove 4104 is configured to be snapped with the side plate 3103, which is provided with the docking slot 510 of the first member 310, on a region opposite to the opening. The docking portion 610 of the second member 410 slides along through the docking slot 510 into the first member 310, whereby the docking portion 610 of the second member is embedded in the first member 310, so as to form a secure connection between the first member 310 and the second member 410, allowing the formation of a detachable cushion structure.

By having this snap-on or plug-in design for its various members, the cushion structure is convenient to assemble and has a reliable performance. In addition, by modifying the structural and compositional designs of its various members, different features can be implemented allowing the making of a multi-functional or universal cushion structure, with components of high interchangeability.

As shown in FIG. 1, a cushion structure described above can be applied in electronic device 200 packaging. The cushion structure is mounted in the packaging case 100 for the electronic device 200, wherein the side plate 4103 of the second member 410 is mounted in the packaging case 100.

The first member 310 with different properties can be used. In one example of the cushion structure, the first member 310 can be made of rubber, which is a material that has outstanding anti-static and cushioning properties, and is detachably connected with the second member 410, and the cushion structure as such can provide good protection of the electronic device 200.

By increasing the thickness of the side plate 3105 in the first member 310, the cushion structure can still provide satisfactory cushioning to the electronic device 200 in situations such as where the packaging case is not fully occupied, or where it undergoes air shipping or movement which accompanies fierce vibration, thus preventing the electronic device 200 from being damaged.

In the second implementation, as shown in FIGS. 9 and 11, the second member 430 comprises a first parallel plate 4303, a second parallel plate 4301, and an intermediate plate 4302, wherein the first parallel plate 4303 and the second parallel plate 4301 are arranged to be parallel, the intermediate plate 4302 is arranged to be perpendicular to, and configured to couple, the first parallel plate 4303 and the second parallel plate 4301, and the first parallel plate 4303 is a docking portion 630.

Along a direction parallel to the crossline between the intermediate plate 4302 and the first parallel plate 4303 and towards the second parallel plate 4301, the two ends of the first parallel plate 4303 are respectively provided with a first docking groove 4304 and a second docking groove 4305. The side plate 3301 of the hollow structure of the first member 330 is provided with a first docking slot 531 and a second docking slot 532, and one of the first docking groove 4304 and the second docking groove 4305 is snapped with the first docking slot 531 on the side plate 3301, and the other of the first docking groove 4304 and the second docking groove 4305 is snapped with the second docking slot 532 on the side plate 3301.

When assembling the cushion structure, it is configured such that two different configurations of such structures are possible. The first docking groove 4304 can be snapped with the first docking slot 531 whereas the second docking groove 4305 can be snapped with the second docking slot 532, so as to form a first configuration of cushion structure.

The second docking groove 4305 can be snapped with the first docking slot 531 whereas the first docking groove 4304 can be snapped with the second docking slot 532, so as to form a second set of cushion structure. The different sets of cushion structures can be used in different corners of the packaging case 100 for packaging of the electronic device 200, as illustrated in FIGS. 2A and 2B. For example, if the electronic device 200 is a display device such as a LCD or LED screen, the four corners of the packaging case 100 would provide much of the cushion and protection.

In conventional packaging technologies, two or even four different sets of cushion structures need to be molded. Therefore, the cost associated with molding can be significantly reduced by adopting the interchangeable members disclosed herein.

Figure 14:
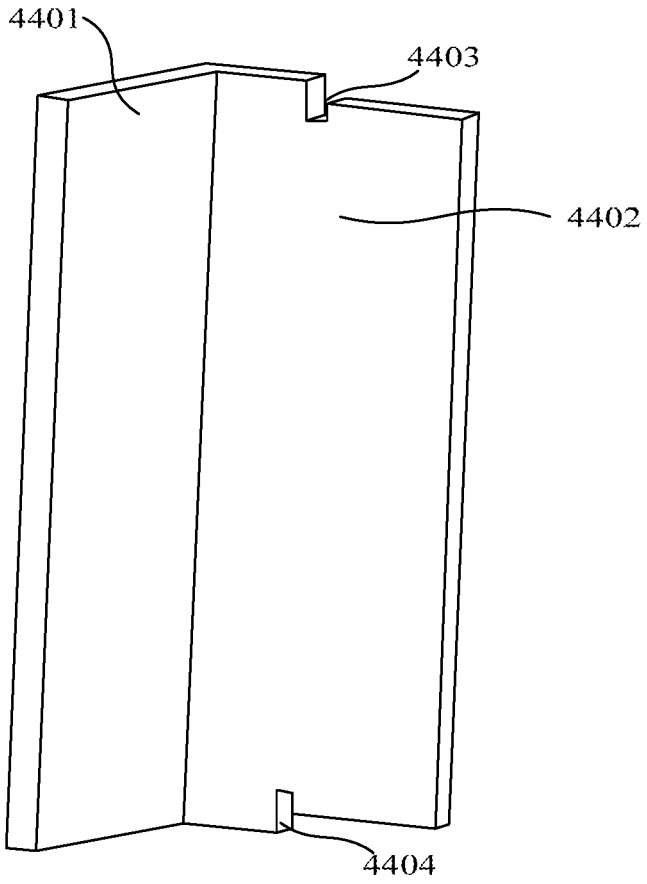
FIG. 14 is a schematic diagram of a second member of the cushion structure as illustrated in FIG. 12, according to some embodiments.

In some embodiments, the second member 400 can be arranged to have a cross section shaped substantially as an "L," illustrated as the second member 440 in FIG. 14, and the second member 440 can be assembled with the first member 340, shown in FIGS. 12 and 13 as Approach 4 of the first member 300 having a cuboid structure, to form a cushion structure.

As shown in FIGS. 12 and 14, the second member 440 comprises a fixing plate 4401, which is configured to attach the case body of the packaging case 100, and a docking plate 4402, which is the docking portion 640. At a direction in parallel to the crossline between the fixing plate 4401 and the docking plate 4402, the docking plate 4402 is provided with a first docking groove 4403 and a second docking groove 4404, wherein the first docking groove 4403 and the second docking groove 4404 extend in a direction in parallel with the crossline between the fixing plate 4401 and the docking plate 4402, and have their respective openings at opposite directions.

The docking plate 4402 of the second member 440 can be snapped with the side plate 3402 of the first member 340 through the first docking slot 541 and the second docking slot 542 on the side plate 3402 of the first member 340, and through the first docking groove 4403 and the second docking groove 4404 on the docking plate 4402 of the second member 440. The second docking groove 4404 can be snapped with the first docking slot 541 on the side plate 3402 whereas the first docking groove 4403 can be snapped with the second docking slot 542 on the side plate 3402, so as to form a first set of cushion structure; and the first docking groove 4403 can be snapped with the first docking slot 541 on the side plate 3402, whereas the second docking groove 4404 can be snapped with the second docking slot 542 on the side plate 3402, so as to form a second set of cushion structure.

In this configuration, the cost associated with molding of the two sets of cushion structure can be significantly reduced.

Figure 8:
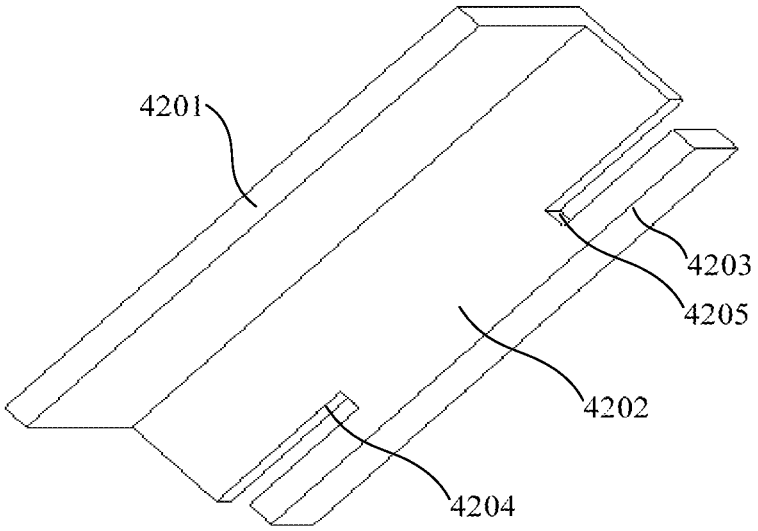
FIG. 8 is a schematic diagram of a second member of the cushion structure as illustrated in FIG. 6, according to some embodiments.

In some embodiments, the second member 400 can be arranged to have a cross section shaped as "Z," illustrated as the second member 420 in FIG. 8.

The second member 420 can be assembled with the first member 330, shown in FIGS. 6 and 7 as Approach 2 of the first member 300 having a cuboid structure, to form a cushion structure. Alternatively the second member 420 can be assembled with the first member 340, shown in FIGS. 12 and 13 as Approach 4 of the first member 300 having a cuboid structure, to form a cushion structure.

As shown in FIGS. 6 and 8, the second member 420 comprises parallel arranged third parallel plate 4203 and fourth parallel plate 4201, and an intermediate plate 4202, wherein the intermediate plate 4202 is perpendicular to the third parallel plate 4203, and connects, and the third parallel plate 4203 and the fourth parallel plate 4201. The third parallel plate 4203 is the docking portion 620, and the intermediate plate 4202 is provided with a first docking groove 4204 and a second docking groove 4205, wherein the first docking groove 4204 and the second docking groove 4205 are located on the intermediate plate 4202 at a region opposite to the fourth parallel plate 4201, and have their openings formed opposite to each other and between the intermediate plate 4202 and the third parallel plate 4203.

As shown in FIG. 7, the first member 320 is provided with one opening at one end, the docking slot 520 is arranged on a side plate 3204 of the cuboid and connects the opening, wherein the side plate 3204 is next to the opening in the cuboid. One of the first docking groove 4204 and a second docking groove 4205 is snapped with the side plate 3204 of the first member 320, which is provided with the docking slot 520, at a region opposite to the opening. By this configuration, the docking slot 520 of the first member 320 can snap with either the first docking groove 4204 or the second docking groove 4205 of the second member 420 to form cushion structure, thus having a more generalized use, leading to savings of the cost associated with molding of the second member 420.

Alternatively, as shown in FIGS. 12-14, the first docking slot 541 and the second docking slot 542 are arranged on the side plate 3402 of the hollow structure of the first member 340; one of the first docking groove 4204 and a second docking groove 4205 is snapped with the first docking slot 541, whereas the other one of the first docking groove 4204 and a second docking groove 4205 is snapped with the second docking slot 542 at the other end. By this configuration, the first docking slot 541 of the first member 340 can snap with either the first docking groove 4204 or the second docking groove 4205 of the second member 420 to form cushion structure, thus having a more generalized use, leading to savings of the cost associated with molding of the second member 420.

In the electronic device 200 packaging industry, cushioning and protection of electronic device 200 is typically provided by the various sides on the four corners of the device. However, in some other electronic devices 200 that have special sizes, shapes, structures or circuits, a typical packaging case 100 is unable to provide sufficient positioning and cushioning to the electronic devices 200, and may require the use of the cushion structure that combines the first member 320 and the second member 420.

As shown in FIG. 2 and FIG. 8, in the cushion structure formed by matching the first member 320 and the second member 420, as a result of having both the first docking groove 4204 and the second docking groove 4205 of the second member 420, the cushion structure can be used universally in either side of the packaging case 100 for the electronic devices 200, leading to savings of the cost associated with molding of one set of the second member 420.

The present disclosure also provides a packaging assembly, comprising a packaging case 100, and at least one cushion structure, wherein the at least one cushion structure is located inside, and mounted on a case body of, the packaging case 100, and the at least one cushion structure can be selected from any of the cushion structures described above. Because the cushion structures used in packaging cases can form secure connections between different cushion members and have a low operational cost, the packaging assembly can provide a good protection of the electronic device 200 disposed therein, and also enjoy a low operational cost.

In some embodiments, the case body of the packaging case 100 further comprises a mounting groove for the installation of the second member 400 of the cushion structure. When packaging of electronic devices 200, the second member 400 is mounted into the mounting groove, the first member 300 and the second member 400 can be plugged and matched to form a cushion structure, and the cushion structure together with the packaging case 100 can provide positioning, cushioning and protection of the electronic devices 200 disposed in the packaging case 100.

Specifically, the second member 400 is detachably mounted in the mounting groove. When removing or replacing the second member 400, the second member 400 can be conveniently removed or replaced because the second member 400 is detachably mounted in the mounting groove.

One or more of the various embodiments described above therefore can have one or more of, but are not limited to, the following advantages.

For example, the interchangeability of the different members, insets, or components allow for the flexibility of the cushion structure. The universality of the cushion structure resulting from the assembly of the different members, insets, or components allow for packaging large objects, such as fragile objects with different shapes. The secure connections and conformability of the cushion structures can better protect sensitive electronics such as liquid crystal displays from damages during moving or transportation. The cushion structures also enjoy lower operational cost, better recyclability because different members or components can be separately recycled, and ease of assembly/operation/packaging. There is no need for adhesives or welding such as ultrasonic welding, etc., although these conventional coupling techniques can also be employed in some of the embodiments disclosed herein. Other advantages may become apparent to those of ordinary skill in the art.

Although specific embodiments have been described above in detail, the description is merely for purposes of illustration. It should be appreciated, therefore, that many aspects described above are not intended as required or essential elements unless explicitly stated otherwise. Various modifications of, and equivalent acts corresponding to, the disclosed aspects of the exemplary embodiments, in addition to those described above, can be made by a person of ordinary skill in the art, having the benefit of the present disclosure, without departing from the spirit and scope of the disclosure defined in the following claims, the scope of which is to be accorded the broadest interpretation so as to encompass such modifications and equivalent structures.

The invention claimed is:

1. A cushion structure for use with a packaging case for an object, the cushion structure comprising a first member and a second member, wherein:

the first member is configured to snuggly receive the object;

the second member is configured to be mounted onto a case body of the packaging case;

the first member and the second member are detachably coupled with at least one docking slot arranged at the first member, and at least one docking portion arranged at the second member;

the at least one docking portion is configured to be detachably mounted into the at least one docking slot;

the first member further comprises a hollow structure;

the at least one docking slot is arranged on a side plate of the hollow structure;

the at least one docking portion of the second member is configured to be embedded in the hollow structure through the at least one docking slot;

the first member comprises a cuboid structure;

the second member has an "I"-shaped, "L"-shaped, or "Z"-shaped cross section;

the second member has a "Z"-shaped cross section, and comprises:

a first plate;

a second plate; and an intermediate plate; and the first plate and the second plate are arranged to be parallel, the intermediate plate is arranged to be perpendicular to, and is configured to couple, the third parallel plate and the second plate, and the third parallel plate is the at least one docking portion.

2. The cushion structure of claim 1, wherein the first member comprises an anti-static material, and the object comprises a static-electricity-sensitive object.

3. The cushion structure of claim 2, wherein the anti-static material is a flexible material.

4. The cushion structure of claim 1, wherein the second member comprises acrylonitrile butadiene styrene.

5. The cushion structure of claim 1, wherein the second member further comprises two docking grooves, having opposing openings and arranged on the intermediate plate on a region facing away from the second plate and between the intermediate plate and the first plate.

6. The cushion structure of claim 5, wherein:

one end of the first member is provided with an opening, wherein the side plate is at a periphery of the opening of the cuboid structure, and the at least one docking slot on the side plate is coupled with the opening; and one of the two docking grooves is mounted through the at least one docking slot with the side plate on a region of the side plate opposite to the opening.

7. The cushion structure of claim 5, wherein:

the side plate of the hollow structure of the first member is provided with two docking slots; and one of the two docking grooves is mounted with one of the two docking slots at one end of the side plate, and another one of the two docking grooves is mounted with another one of the two docking slots at another end of the side plate.

8. A packaging assembly, comprising a packaging case, wherein the packaging case comprises at least one cushion structure according to claim 1 snuggly fit therein, and the at least one cushion structure is disposed in, and coupled with a case body of, the packaging case.

9. The packaging assembly of claim 8, wherein the at least one cushion structure is coupled with the case body of the packaging case through a detachable mechanism, and wherein the detachable mechanism comprises at least one mounting groove, arranged on the case body of the packaging case and configured to mount the second member.

* * * * *